United States Patent [19]

Johansson

[11] Patent Number: 4,845,954

[45] Date of Patent: Jul. 11, 1989

[54] METHOD AND DEVICE FOR THE MANUFACTURE OF AN ICE SLURRY

[75] Inventor: Yngve Johansson, Norrköping, Sweden

[73] Assignee: Stal Refrigeration AB, Norrkoping, Sweden

[21] Appl. No.: 203,096

[22] Filed: Jun. 7, 1988

[30] Foreign Application Priority Data

Jun. 10, 1987 [SE] Sweden ..... 8702405

[51] Int. Cl.[4] ..... F25B 19/00

[52] U.S. Cl. ..... 62/66; 62/268; 62/340; 62/100

[58] Field of Search ..... 62/66, 268, 270, 340, 62/348, 100

[56] References Cited

U.S. PATENT DOCUMENTS

| | | | |
|---|---|---|---|
| 828,887 | 8/1906 | Hoofnagle | 62/270 X |
| 828,888 | 8/1906 | Hoofnagle | 62/268 |
| 1,976,204 | 10/1934 | Voorhess et al. | 62/172 |
| 2,426,368 | 8/1947 | Mayne et al. | 62/268 |
| 3,202,343 | 8/1965 | Emmermann et al. | 230/127 |

FOREIGN PATENT DOCUMENTS 147833 12/1984 Denmark .

*Primary Examiner*—William E. Tapolcai
*Attorney, Agent, or Firm*—Watson, Cole, Grindle & Watson

[57] ABSTRACT

Ice is formed by allowing water to partially evaporate in a vacuum. The ice can then be removed and be collected for subsequent use. For the creation of the vacuum, means for reduction of the pressure are required. A vapor compressor may be used for suction and compression of the water vapor to a pressure which enables condensing on a cold surface without freezing occurring. To be able to manufacture ice in a vacuum without using an expensive water vapor compressor, a method and a device for the manufacture of an ice slurry include which several cooperating vacuum chambers (1, 2, 3) with cold surfaces (6, 7, 8) used in a plant without a water vapor compressor. In this plant fresh water is supplied to one of the vacuum chambers for defrosting thereof, the thermal energy of the fresh water being utilized for that purpose. The precooled water thus formed is supplied to the other vacuum chambers, in which they will then form ice. From the chambers the formed ice is brought via pumps (22, 23, 24) to a collecting vessel (26), in which the proportion of ice in the ice slurry, thus formed, is increased by separating ice and water. The water is returned to the chambers and the ice slurry is removed for use or storage.

6 Claims, 2 Drawing Sheets

METHOD AND DEVICE FOR THE MANUFACTURE OF AN ICE SLURRY

TECHNICAL FIELD

The present invention relates to a method and a device for the manufacture of an ice slurry, in which water is partially allowed to evaporate in a vacuum while forming ice.

BACKGROUND ART

An ice slurry can be used for cooling, for example in the manufacture of concrete or in mining. Making ice in a vacuum is known and used, inter alia, for desalination of sea water. In, for example, U.S. Pat. No. 1,976,204 and U.S. Pat. No. 3,202,343, the manufacture of ice in a vacuum is described. In DK B No. 147 833 a method and a device for the manufacture of ice in loose form are described, in which vapour from a vacuum vessel containing water is sucked off by means of a vapour compressor. The vapour is then compressed to a preset pressure to enable condensing on a cold surface without freezing occurring. A water vapour compressor is comparatively too expensive to be used in these applications.

DISCLOSURE OF THE INVENTION

To be able to manufacture ice in a vacuum without the use of a water vapour compressor, by which water vapour is sucked off and then compressed to a pressure enabling condensing on a cold surface, a plant for the manufacture of an ice slurry has been designed without a vapour compressor but with several cooperating vacuum chambers with cold surfaces. Fresh water is supplied to one of the vacuum chambers for defrosting thereof, whereby the formed pre-cooled water for the formation of ice is supplied to the other vacuum chambers. The object of the proposed plant is to utilize partially the thermal energy in the fresh water for defrosting of a cold surface. When manufacturing ice from fresh water, heat has to be carried away from the water, partly to cool the water from an original temperature, partly to freeze the water. The vaporization heat of the water under vacuum is about 600 kcal/kg whereas the melting heat is only 80 kcal/kg. To form 1 kg ice slurry in a vacuum chamber, which is supplied with water at the freezing point 0° C., 80/600 kg vapour must thus be formed from the water. If the vapour is allowed to condense and freeze on a surface which is maintained cold, by removing heat therefrom, for each kg of formed ice slurry, 80/600 kg ice will be precipitated on the surface. For each kg of formed ice slurry that is removed from the vacuum chamber, 1 kg fresh water must be supplied in a continuous process. With a heat balance equal to $1\cdot(t-0)=80/600\cdot 80$, it will be found that if the temperature of the fresh water exceeds t° C.=10,7° C., it can be used for defrosting of the cold surface. If the temperature of the fresh water is lower than this temperature, it can be preheated by interchange of heat with the refrigerant condensate in the refrigerating plant.

DESCRIPTION OF THE PREFERRED EMBODIMENT

Figure 1:
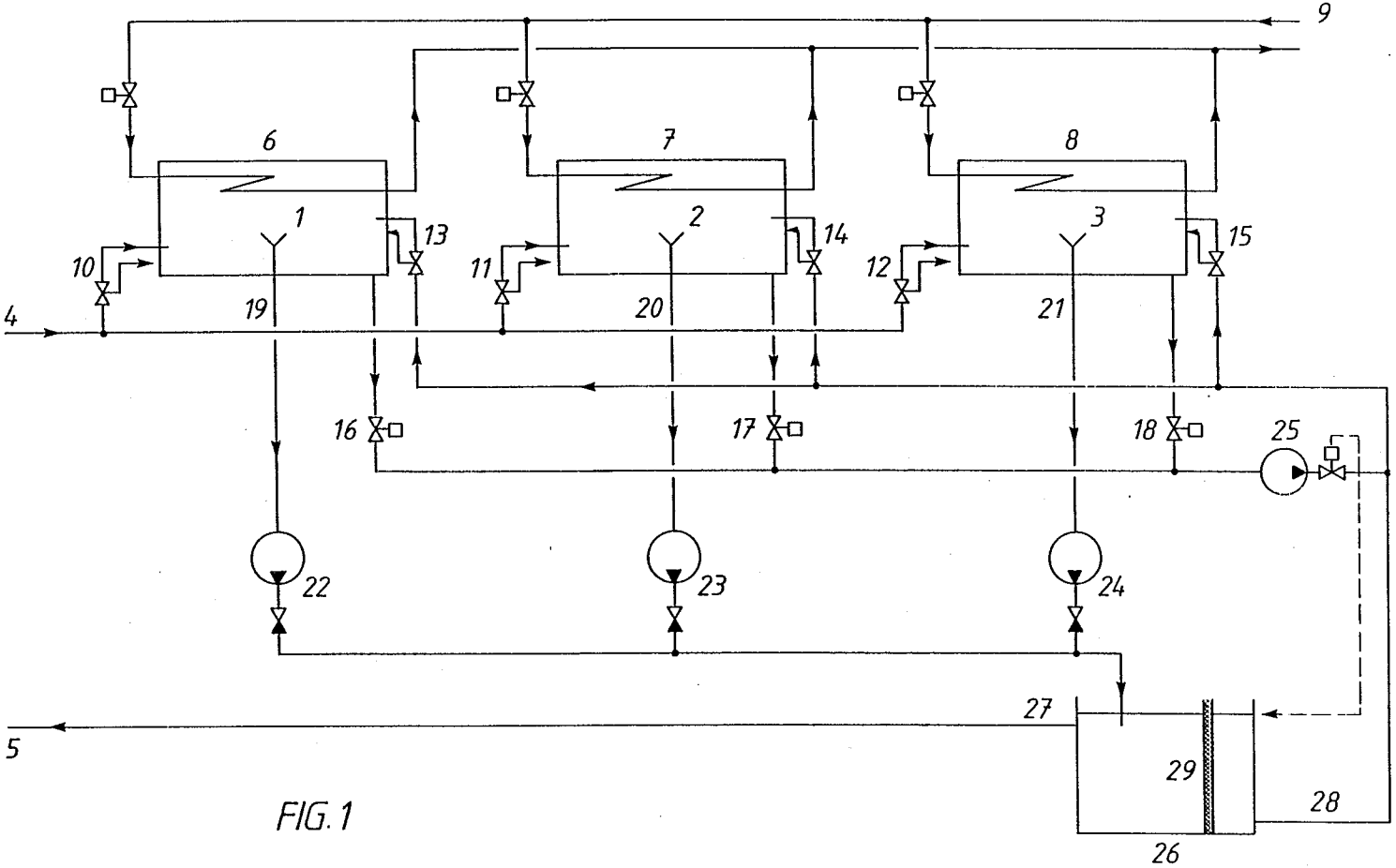
FIG. 1 shows schematically a plant for the manufacture of an ice slurry.

FIG. 1 shows how a plant for the manufacture of an ice slurry is built up. The plant comprises several vacuum chambers 1-2, each subjected to a vacuum pressure from a source (not shown), the plant having an inlet 4 for fresh water and an outlet 5 for ice slurry. Each vacuum chamber 1–3 has a cold surface 6, 7, 8, which by means of a cooling coil, or the like, is controllably connected to a common refrigerating plant 9. Each vacuum chamber 1–3 is associated with a valve controlled inlet 10, 11, 12 for fresh water, a valve controlled inlet 13, 14, 15 for pre-cooled water from a defrosting operation, a valve controlled outlet 16, 17, 18 for pre-cooled water from a defrosting operation, and an outlet 19, 20, 21 for ice slurry, connected to a pump and a valve 22, 23, 24. The fresh water inlet 4 is connected to the valve controlled inlets 10, 11 and 12. The valve controlled outlets 16, 17, 18 are connected to a pump 25 for pumping of the pre-cooled water to the valve controlled inlets 13, 14, 15. The pumps with valves 22, 23, 24 are connected to a common outlet into a collecting vessel 26 having means 29 for separating water from ice/ice slurry. The collecting vessel 26 has an outlet 27 for ice slurry and an outlet 28 for cooled water. The outlet 28 is connected to the valve controlled inlets 13, 14, 15 into the vacuum chambers 1–3.

Figure 2:
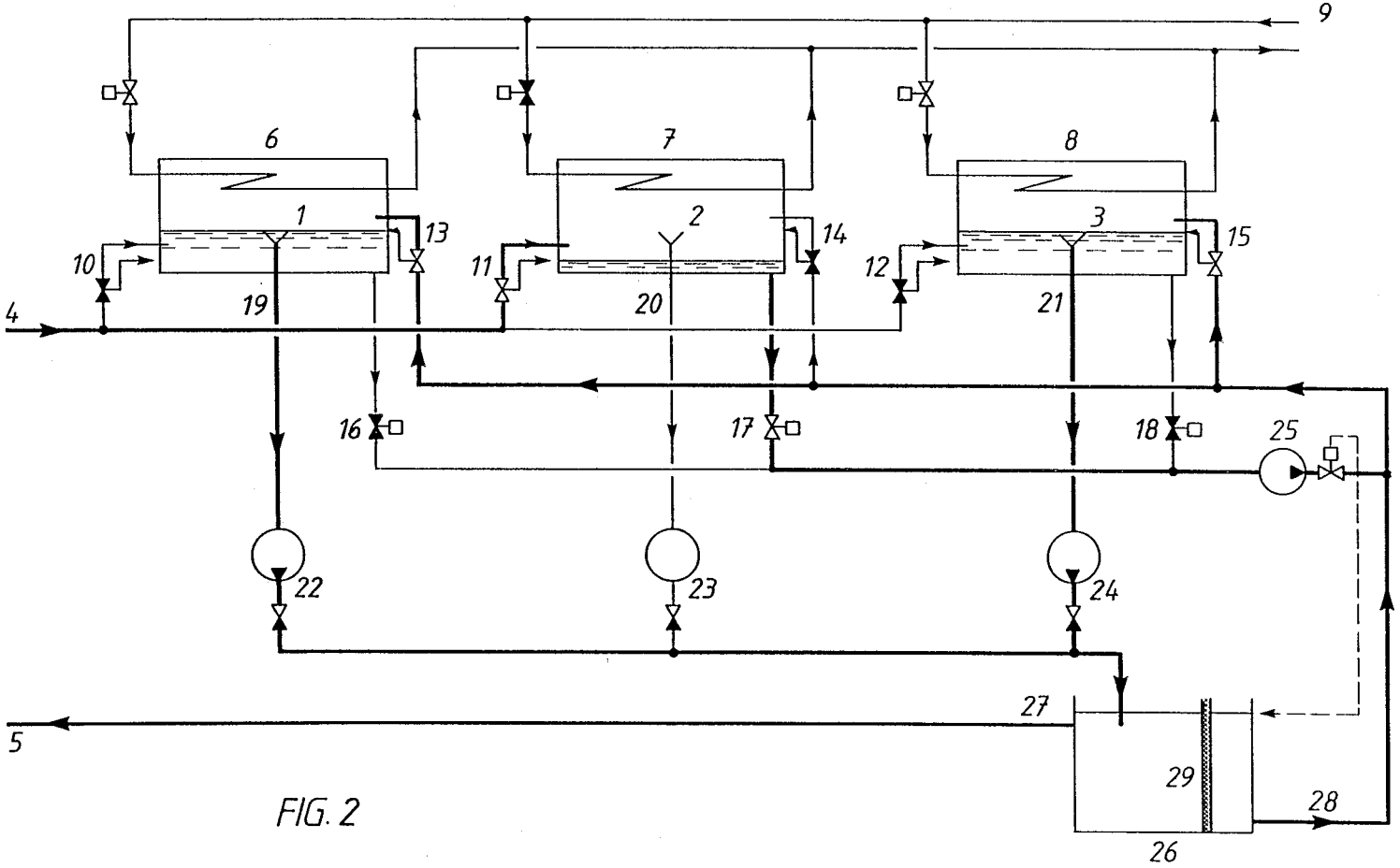
FIG. 2 shows the operating sequence with flows of fresh water and ice slurry, with valves opened or closed, with pumps operating or non-operating.

FIG. 2 shows how the plant for the manufacture of an ice slurry operates with valves opened and closed and pumps operating and non-operating. In FIG. 2 valves and pumps which are filled indicates that they are shut-off and non-operating, respectively.

The fresh water at 4 is brought direct to the vacuum chamber 2 when the valves 10 and 12 are shut off and the valve 11 is open. The fresh water supplied to the vacuum chamber 2 with a shut-off cooling coil will defrost the chamber 2. Cooled water from the defrosting operation passes out of the chamber 2 past the open valve 17 and further to the pump 25. The pump 25 delivers the pre-cooled water with a possible addition of cooled water from the outlet 28 of the collecting vessel 26. The cooled water is then supplied to the vacuum chambers 1 and 3 via the open valves 13 and 15 whereas the valve 14 shuts off the passage to the chamber 2. From the chambers 1 and 3 with open cooling coils, the ice formed therein is then pumped by the pumps 22, 24 to the collecting vessel 26. The proportion of ice in the ice slurry is increased by separating ice and water. The water is then returned to the chambers. The ice slurry is passed on from the outlet 27 of the collecting vessel 26 to the exhaust 5 for the ice slurry.

I claim:

1. A method for the manufacture of an ice slurry by injecting water into a vacuum chamber in which prevails such a low pressure that the water is evaporated comprising the steps of providing several cooperating vacuum chambers, each one provided with a controllably cooled surface, supplying fresh water to at least one of the several vacuum chambers for defrosting thereof and for forming pre-cooled water, returning the pre-cooled water to the remaining cooled vacuum chambers for evaporation and the formation of ice, while the vapor is allowed to condense and freeze on the controllably cooled surface, removing the ice by pumping to a collecting vessel with separation of water before further transport, use or storage.

2. A device for the manufacture of an ice slurry by injecting water into a vacuum chamber, in which prevails such a low pressure that the water is evaporated, comprising several cooperating vacuum chambers each having a valve controlled connection for supplied fresh water, and each having a valve controlled connection for supplied precooled water from a pump or from a collecting vessel, a valve controlled outlet leading from each chamber, for removed precooled water from the vacuum chambers, an outlet leading from each chamber for removed formed ice slurry, and a controllably cooled side at each chamber, and the outlets from the vacuum chambers being connected by a pump means to the collecting vessel provided with means for separation of water from ice and having an outlet connected to a discharge for the ice slurry.

3. Device according to claim 2, wherein the valve controlled connections are connected to a common conduit for the fresh water.

4. Device according to claim 2, wherein a valve controlled cooling coil connected to a common refrigerating plant is associated with each vacuum chamber.

5. Device according to claim 2, wherein the valve controlled outlets are commonly connected to the pump for returning the precooled water to the valve controlled connections.

6. Device according to claim 2, wherein separated water from the collecting vessel is adapted to be returned downstream of the pump to the valve controlled connections.

* * * * *